United States Patent [19]

Kishimoto

[11] Patent Number: 4,630,451

[45] Date of Patent: Dec. 23, 1986

[54] REFRIGERATED DISPLAY CABINET

[75] Inventor: Daisaburo Kishimoto, Tatebayashi, Japan

[73] Assignees: Sanyo Electric Co., Ltd; Tokyo Sanyo Electric Co., Ltd, both of Japan

[21] Appl. No.: 634,807

[22] Filed: Jul. 26, 1984

[30] Foreign Application Priority Data

Oct. 20, 1983 [JP] Japan ..... 58-197030

[51] Int. Cl.[4] ..... A47F 3/04

[52] U.S. Cl. ..... 62/247; 62/256

[58] Field of Search ..... 62/247, 256; 261/DIG. 48

[56] References Cited

U.S. PATENT DOCUMENTS

| | | | |
|---|---|---|---|
| 2,066,312 | 1/1937 | Bales | 62/247 X |
| 2,243,958 | 6/1941 | Hermann | 62/247 |
| 2,625,806 | 1/1953 | Kennedy | 62/247 |
| 4,031,171 | 6/1977 | Asao et al. | 261/DIG. 48 |
| 4,087,495 | 5/1978 | Umehara | 261/DIG. 48 |
| 4,197,991 | 4/1980 | D'Amato | 98/30 X |
| 4,257,989 | 3/1981 | Nishikawa | 261/DIG. 48 |

FOREIGN PATENT DOCUMENTS

| | | | |
|---|---|---|---|
| 541791 | 9/1921 | France | 62/247 |

*Primary Examiner*—William E. Wayner

*Attorney, Agent, or Firm*—Darby & Darby

[57] ABSTRACT

A refrigerated display cabinet includes an insulating cabinet body having an open lateral or upper side, a partition plate disposed in the cabinet body and defining therein a storage chamber and a cooled air passage having an outlet extending along one edge of the open side and an inlet extending along an opposite edge thereof, a refrigerating unit and an air blower disposed in the cooled air passage for forcibly circulating cooled air to form an air curtain across the open side and cool the storage chamber, a humidifier unit disposed in the body outside of the storage chamber for producing a mist, and outlet pipe means for delivering the mist produced by the humidifier unit for being mixed in the forcibly circulated cooled air, the outlet pipe means having an outlet port positioned in the storage chamber in the vicinity of the outlet of the cooled air passage.

7 Claims, 10 Drawing Figures

REFRIGERATED DISPLAY CABINET

BACKGROUND OF THE INVENTION

1. Field of the invention

The present invention relates to a refrigerated display cabinet for humidifying and refrigerating a storage chamber by mixing a mist from a humidifier unit into a forcibly circulating flow of cooled air.

2. Description of the Prior Art

Japanese Laid-Open Patent Publication No. 55-46383 discloses a humidifier unit for supplying a mist generated by ultrasonic vibrators into a cooled air passage in a refrigerated display cabinet to prevent fresh produce articles displayed in the cabinet from being dried and hence keep them fresh. With the conventional construction, the humidifier with the ultrasonic vibrators is placed on an upper front end of a partition plate which defines the cooled air passage inwardly of heat insulating wall, and the mist generated by the humidifier unit is supplied through a distributor into the cooled air passage upstream of a cooled air outlet thereof. The prior humidifier unit construction has suffered from the following disadvantages:

(1) Since the humidifier unit is disposed in the produce storage chamber in the refrigerated display cabinet, water in an atomizing water tank and water supplied through a water supply pipe to the atomizing water tank are cooled, and will not be atomized at a high rate (a larger quantity of mist can be generated by the ultrasonic vibrators when the temperature of water to be atomized is higher).

(2) The water in the atomizing water tank and the water supply pipe is liable to get frozen when the operation of the humidifier unit is stopped. Therefore, it is necessary to mount electric heaters on outer peripheral surfaces of the atomizing water tank and the water supply pipe, with the result that the humidifier unit is complex in structure.

(3) As the atomizing water tank and the water supply pipe are positioned in the produce storage chamber, they are visible and the display cabinet has a poor appearance.

(4) With the water supply pipe and the distributor located in the cooled water passage, part of the generated mist will be turned into water droplets before it reaches the outlet due to a viscosity resistance by the wall surfaces of the distributor and the cooled air passage. This lowers the humidifying capability.

SUMMARY OF THE INVENTION

With the above drawbacks in view, it is an object of the present invention to free a humidifier unit substantially from cooled or refrigerated air and to effectively humidify a storage chamber in a refrigerated display cabinet by mixing a mist from the humidifier unit directly in an air curtain without passing through a cooled air passage.

According to the present invention, there is provided a refrigerated display cabinet comprising an insulating cabinet body having an open lateral or upper side, a partition plate disposed in the cabinet body and defining therein a storage chamber and a cooled air passage having an outlet extending along one edge of the open side and an inlet extending along an opposite edge thereof, a refrigerating unit and an air blower disposed in the cooled air passage for forcibly circulating cooled air to form an air curtain across the open side and cool the storage chamber, a humidifier unit disposed in the body outside of the storage chamber for producing a mist, and outlet pipe means for delivering the mist produced by the humidifier unit for being mixed in the forcibly circulated cooled air, the outlet pipe means having an outlet port positioned in the storage chamber in the vicinity of the outlet of the cooled air passage. With this arrangement, the outlet port of the outlet pipe means is positioned in the storage chamber in the vicinity of the outlet for discharging the air curtain. The mist can be mixed in the air curtain without passing through the cooled air passage for effectively humidifying the storage chamber. Since the mist is supplied at the upstream portion of the air curtain in the storage chamber, the mist will not escape out of the storage chamber and can efficiently humidify the storage chamber only.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
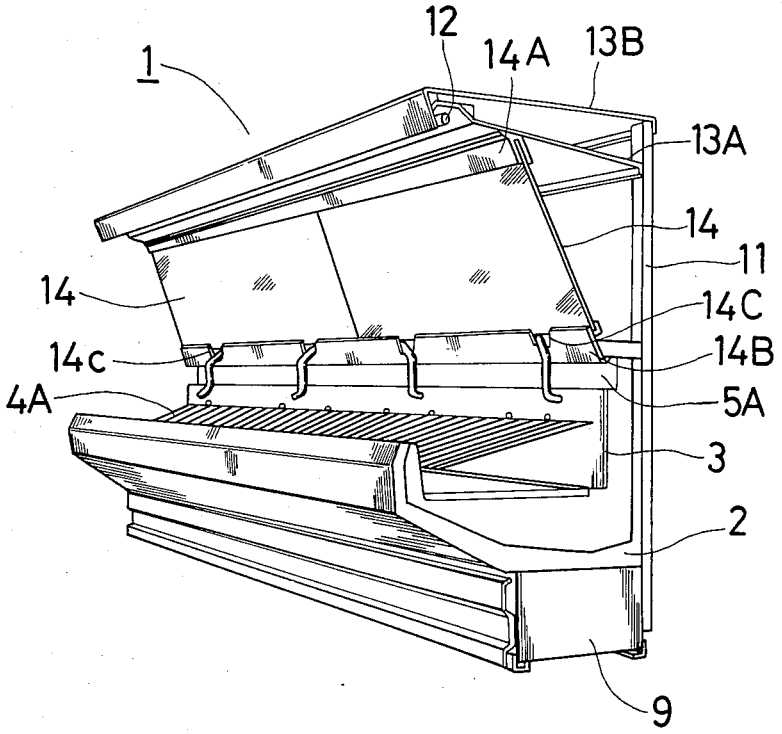
FIG. 1 is a perspective view of a refrigerated display cabinet according to the present invention.
Figure 2:
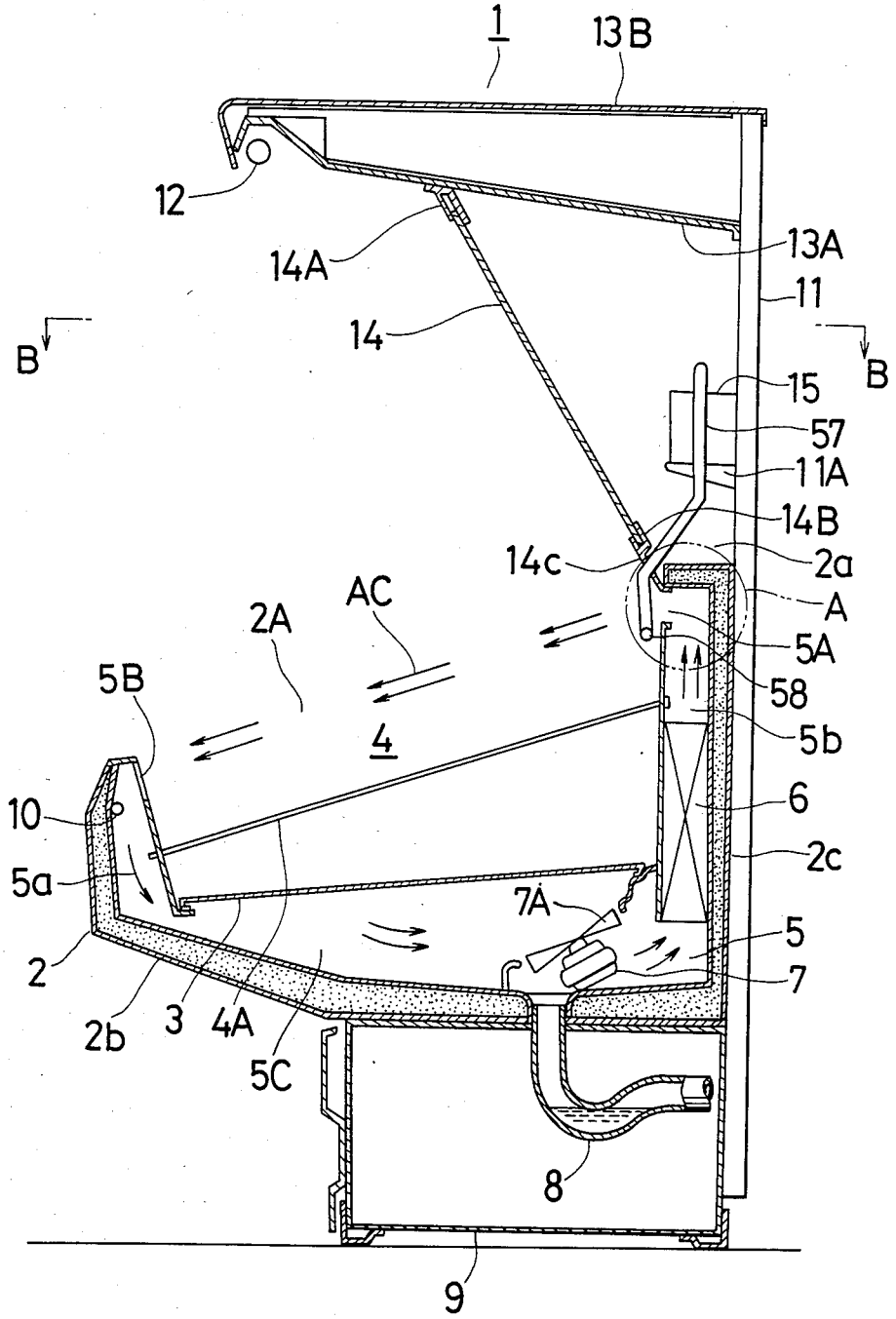
FIG. 2 is a vertical cross-sectional view of the refrigerated display cabinet shown in FIG. 1.
Figure 3:
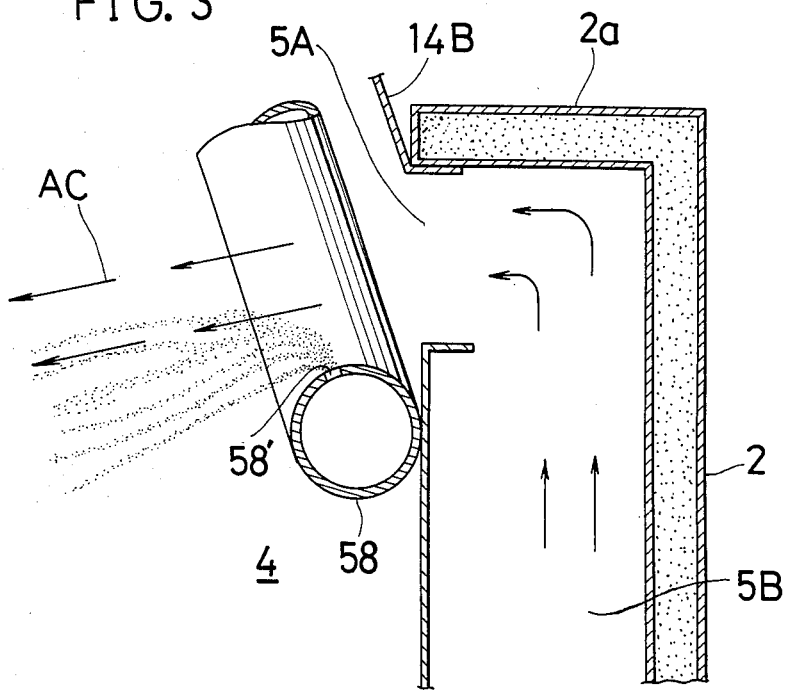
FIG. 3 is an enlarged view of an encircled portion A of FIG. 2.
Figure 4:
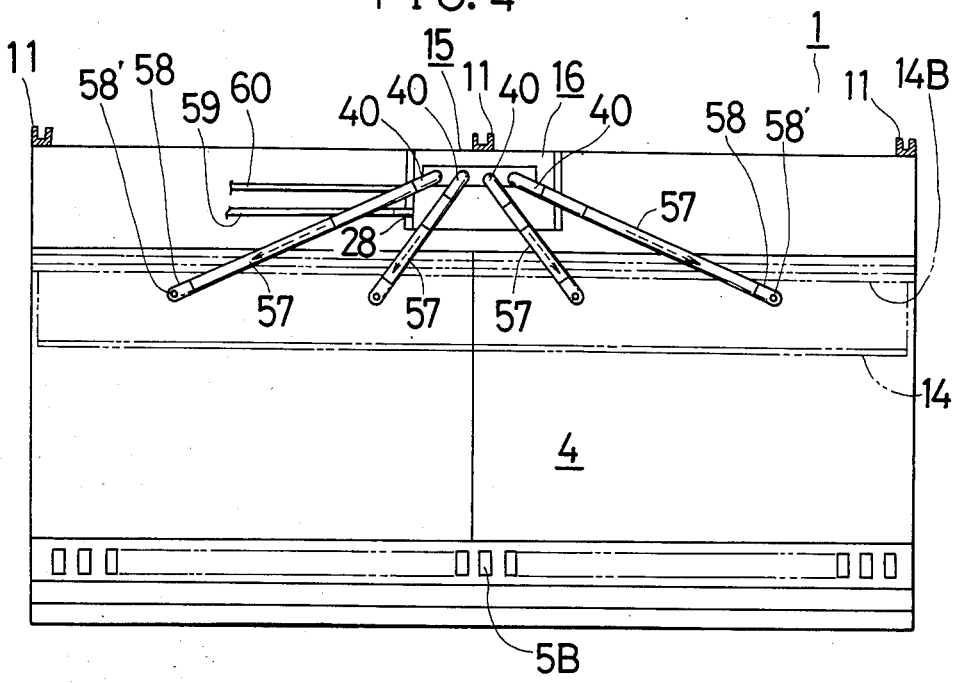
FIG. 4 is a cross-sectional view taken along line B—B′ of FIG. 2.
Figure 5:
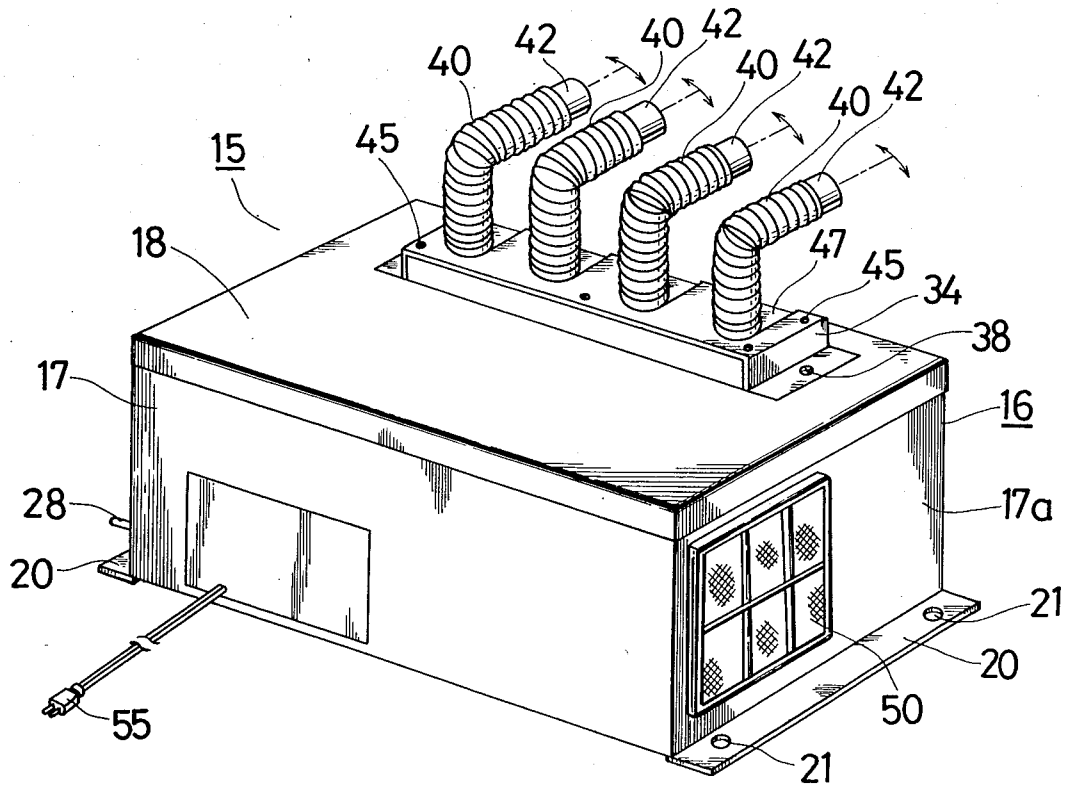
FIG. 5 is a perspective view of a humidifier unit.

As shown in FIGS. 1 and 2, a refrigerated display cabinet 1 has a body composed of a heat insulating wall 2 with an upper opening 2A through which produce articles can be taken into and out of the display cabinet 1. The display cabinet 1 includes a partition plate 3 defining a storage chamber 4 having a rack 4A slanted downwardly toward the front of the display cabinet 1. An inner wall surface of the heat insulating wall 2 and the partition plate 3 jointly define therebetween a cooled air passage 5 including a rear space **5*b* accommodating a plate-fin refrigerating unit 6 and a lower space 5*c* accommodating an axial-flow air blower 7 having a propeller fan 7A. The cooled air passage 5 also includes an outlet 5A defined along a rear edge of the opening 2A, and an inlet 5B disposed in confronting relation to the outlet 5A for forcibly circulating cooled air from the refrigerating unit 6 in the direction of the arrows (FIG. 2) by means of the air blower 7 to thereby form an air curtain AC across the opening 2A for cooling the storage chamber 4. Designated at 8 is a drain pipe disposed on a bottom wall 2b of the heat insulating wall 2, 9 a base supporting the heat insulating wall 2 therein, and 10 a humidity sensor positioned in a front space 5a of the cooled air passage 5 in the vicinity of the inlet 5B for controlling a humidifier unit (described later). A plurality of upstanding columns 11 of metal are attached to a rear wall 2c of the heat insulating wall 2 and spaced at intervals. To upper ends of the columns 11, there are attached an inner top wall 13A of metal having a fluorescent lamp 12 mounted on a front lower edge thereof for illuminating the storage chamber 4 and an outer top wall 13B of matal. Mirrors 14 are disposed upwardly of the air curtain AC and inclined rearwardly at their lower edges. The mirrors 14 have upper edges supported by an upper edge support 14A fixed to the inner top wall 13A, the lower edges of the mirrors 14 being supported by a lower edge support 14B fixed to an upper wall 2a of the heat insulating wall 2. The lower edge support 14B has guide paths 14C** which serve as slots for insertion of hands at the time of slightly lifting the mirrors and also as passages for communication pipes (described later).

Figure 6:
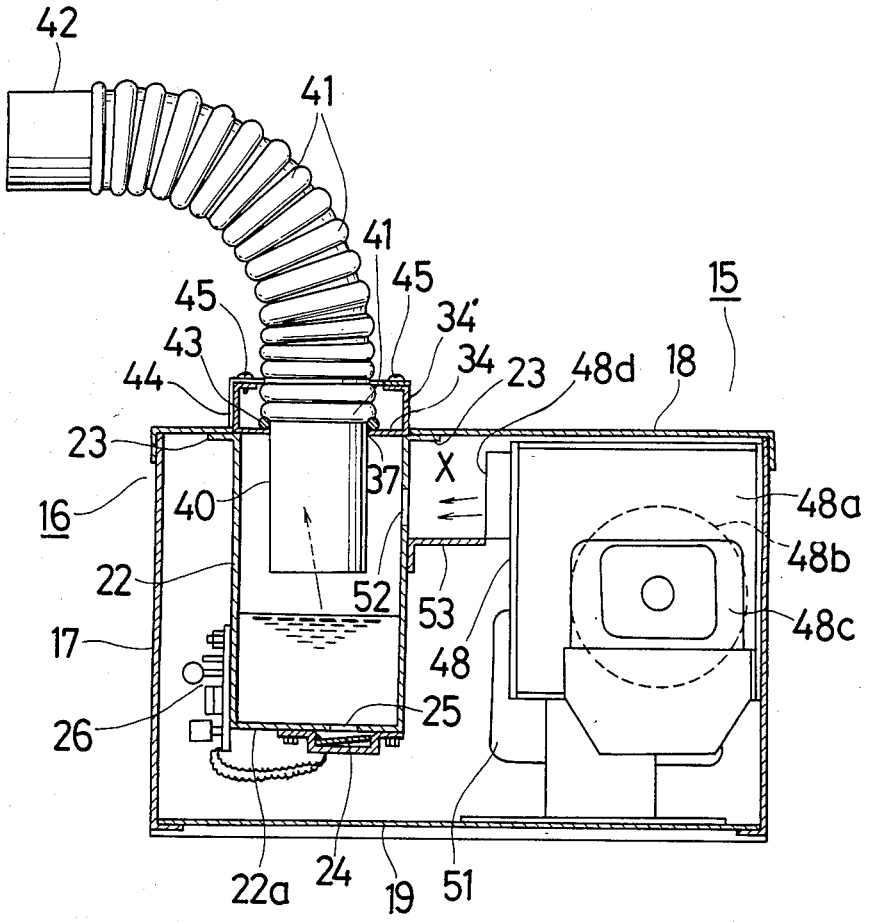
FIG. 6 is a vertical cross-sectional view of the humidifier unit.
Figure 7:
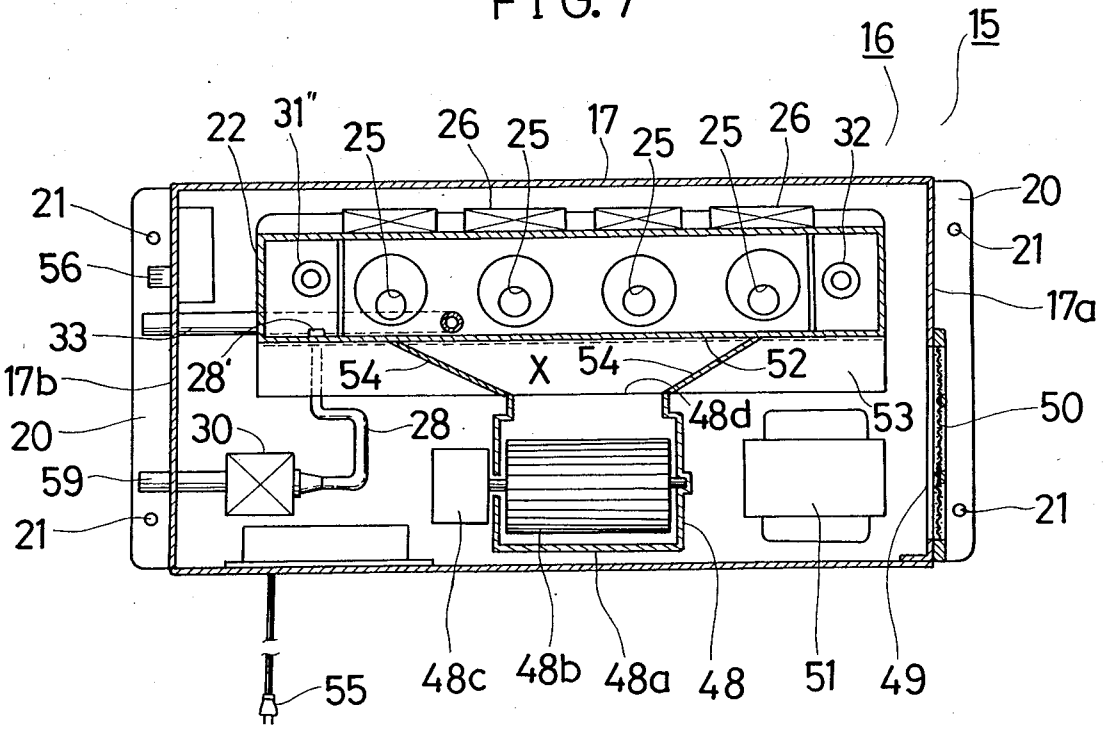
FIG. 7 is a plan view, partly in cross section, of the humidifier unit shown in FIG. 5.

A humidifier unit 15 is mounted on the upper wall 2a of the heat insulating wall 2. The humidifier unit 15 will be described with reference to FIGS. 4 through 8. The humidifier unit 15 has an elongate hollow outer casing body 16 composed of a surrounding side wall 17, an upper plate 18, and a bottom plate 19. The surrounding side wall 17 includes lateral side walls 17a, 17b having lower bent flanges 20, 20 by which the casing body 16 is fixed to an upper surface of a support 11A (FIG. 2) mounted on the column 11, the flanges 20 having screw holes 21, 21. As shown in FIG. 6, in particular, the humidifier unit 15 includes an atomizing water tank 22 of stainless steel sheet disposed in one side of the casing body 16 with upper flanges 23, 23 spot-welded to the underside of the upper plate 18. The atomizing water tank 22 has an upper opening and is of a substantially rectangular, elongate shape when viewed in plan. The water tank 22 includes a bottom plate 22a having four through holes 25 defined therein at spaced intervals in a longitudinal direction and through which ultrasonic vibrators 24 are directed toward the water tank 22. The ultrasonic vibrators 24 are mounted on the lower surface of the bottom plate 22a respectively in alignment with the through holes 25. The ultrasonic vibrators 24 are driven respectively by ultrasonic oscillators 26 mounted in heat transfer relation on a front wall of the water tank 22 for generating water columns 27 (FIG. 8) to produce a mist of fine water particles. As shown in FIG. 7, water is supplied from a water supply system pipe 59 through a water supply pipe 28 having a solenoid-operated valve 30 disposed in the casing body 16 and a water supply port 28' opening into the water tank 22 at an upper portion near one end thereof. A first float switch 31 is disposed in one end of the water tank 22 for detecting a water shortage in the water tank 22 in response to downward movement of the float to de-energize the ultrasonic vibrators 24, which will be prevented from being damaged due to vibration under no load. A second float switch 32 is disposed in the other end of the water tank 22 for opening the solenoid-operated valve 30 when a water level in the water tank 22 is lowered beyond a certain level position to supply humidifying water into the water tank 22 through the water supply port 28'. An overflow pipe 33 is vertically mounted in the water tank 22 and has an upper open end positioned substantially centrally in the water tank 22 for allowing an overflow of water therethrough when the water level is raised beyond the given level position at the time the solenoid-operated valve 30 malfunctions.

The upper opening of the water tank 22 is closed by a lid or cover plate 34 from which depends partition plates 35, 36 for preventing water waves generated by the actuation of the vibrators 24 from affecting the float switches 31, 32. The lid plate 34 has four circular holes 37 defined therein at positions inward of the partition plates 35, 36 in alignment with the vibrators 24. The lid plate 34 is removably attached by screws 38 to upper inward lips 39 on the ends of the water tank 22. Hollow cylindrical outlet pipes 40 are mounted on the water tank 22 in vertical alignment with the vibrators 24 and have lower ends fitted respectively in the circular holes 37 in the lid plate 34. Each of the outlet pipes 40 has a plurality of annular ridges 41 formed on an outer periphery as bellows, where the outlet pipe 40 is flexible and bent into a substantially inverted L shape with an upper connector mouth 42 opening laterally as shown in FIG. 6. A resilient seal gasket 43 such as an O-ring is fitted over each of the outlet pipes 40 and sandwiched between the upper surface of the lid plate 34 around the circular hole 37 and the lowermost annular ridge 41 of the outlet pipe 40 for preventing any leakage of the mist from the water tank 22 through the circular hole 37. A retaining plate 44 is fastened by screws 45 to vertical members 34' of the lid plate 34 and has four recesses 47 with their edges engaging in grooves 46 between adjacent annular ridges 41 of the outlet pipes 40 so that the outlet pipes 40 extending through the lid plate 34 are prevented from being pulled out. Each outlet pipe 40 is freely rotatable as indicated by the arrows in FIG. 5.

A cross-flow type air blower 48 is disposed in one side of the casing body 16 opposite to the water tank 22. The air blower 48 is composed of a fan case 48a, a cross-flow fan 48b, and a motor 48c for driving the fan 48b. The air blower 48 draws air through a filter 50 in a suction port 49 defining in a righthand side wall (in FIG. 5) of the casing body 16, introduces air through a lower wall of the fan case 48a into the fan case 48a, and supplies such air under pressure through a discharge port 48d into the water tank 22. A power supply transformer 51 is disposed between the suction port 49 and the air blower 48 and is cooled by an air current drawn into the fan case 48a.

Figure 8:
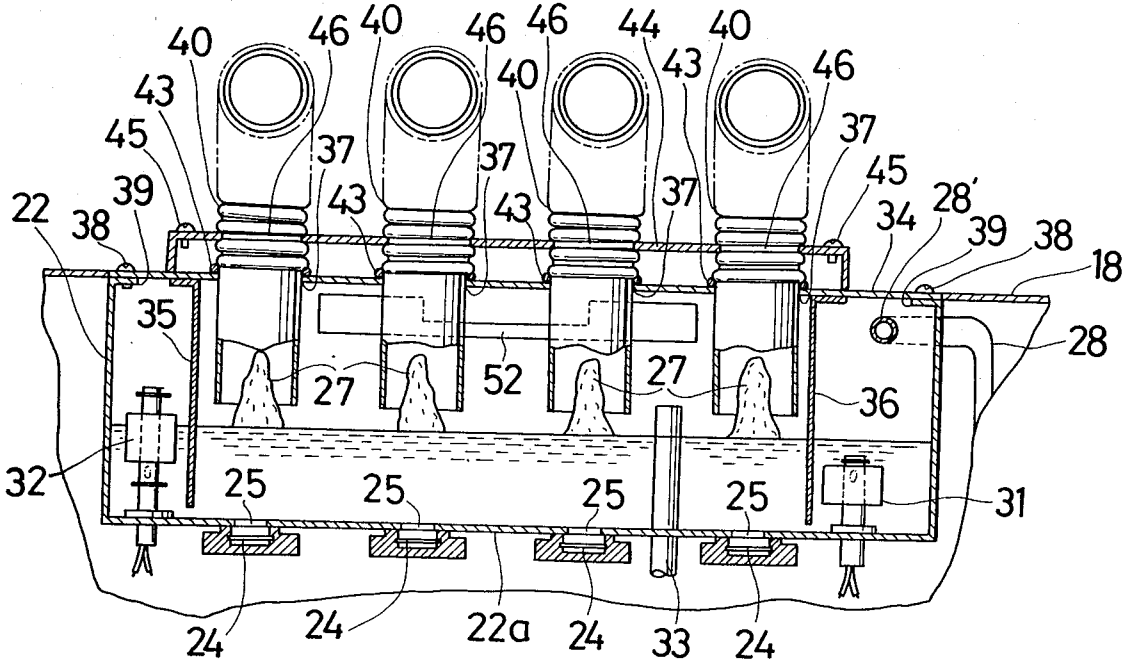
FIG. 8 is a fragmentary cross-sectional view of an atomizing water tank in the humidifier unit.

An air inlet port 52 is defined in an upper portion of a lateral wall portion of the water tank 22 in alignment with the discharge port 48d at a position above the lower open ends of the outlet pipes 40. As illustrated in FIG. 8, the air inlet port 52 is of a horizontally elongate shape having end portions vertically wider than a central portion thereof. A horizontal guide plate 53 is positioned slightly downwardly of the air inlet port 52 and between the water tank 22 and the discharge port 48d of the air blower 48. Vertical guide plates 54, 54 are mounted on the horizontal guide plate 53 and progressively diverge away from each other from the discharge port 48d toward the air inlet port 52. The vertical guide plates 54 and the horizontal guide plate 53 jointly define an air flow passage X between the air blower 48 and the water tank 22. Designated at 55 is a power supply plug, and 56 a power supply switch.

The humidifier unit 15 thus constructed is fixedly mounted on the refrigerated display cabinet 1 by screwing the flanges 20 to the upper wall 2a of the heat insulating wall 2 of the display cabinet 1 as shown in FIGS. 1 and 2. Then, the outlet pipes 40 are turned to orient the connector mouths 42 in a desired direction, and flexible communication pipes 57 are connected at ends to the connector mouths 42. The other ends of the communication pipes 57 are thereafter laid through the guide paths 14C in the lower edge support 14B and across the outlet 5A, and are connected to four pipes 58 having outlet ports 58' opening at an upstream inner stream of the air curtain AC and disposed in the storage chamber in the vicinity of the outlet 5A. It is preferable that the pipes 58 be positioned at substantially equal horizontal intervals in the storage chamber 4 for uniform humidification. The water supply system pipe 59 is connected to the water supply pipe 28, and a water discharge pipe 60 is connected to the overflow pipe 33. The power supply plug 55 is inserted into a plug socket (not shown) on the display cabinet 1. The humidifier unit 15 has now been installed in place in the display cabinet 1.

Operation of the refrigerated cabinet is as follows: When the refrigerated display cabinet 1 is operated with the power supply switch 56 turned on, the air blower 48 and the ultrasonic oscillators 26 start being energized to introduce air under pressure from the discharge port **48*d* through the air inlet port 52 into the atomizing water tank 22 and also to cause the ultrasonic vibrators 24 to generate water columns 27 on the water surface. A mist produced around the water columns 27 is transferred by air from the air blower 48 into the outlet pipes 40 through the outlet pipes 40, the communication pipes 57, and the pipes 58, from which the mist is delivered through their outlet ports 58' to the upstream inner stream of the air curtain AC. Air drawn by the air blower 7 through the inlet 5B into the cooled air passage 5 is accelerated and subjected to a heat exchange by the refrigerating unit 6, and the cooled air flow is discharged through the outlet 5A into the opening 2A as the air curtain AC. The cooled air flow forming the air curtain AC joins the mist supplied from the humidifier unit 15, and refrigerates and humidifies the interior of the storage chamber 6** due to the involving action of the inner stream of the air curtain AC.

With the outlet ports 58' disposed in the storage chamber 4 in the vicinity of the outlet 5A, the mist from the humidifier unit 15 can be entrapped in the upstream inner stream of the cooled air which is discharged into the opening 2A and forms the air curtain AC. Therefore, the mist can be ejected without passing through the cooled air passage 5, and hence will not be partly dewed due to a viscosity resistance by the cooled air passage 5. The mist can be dispersed in the mass of cooled air in the storage chamber 4 for uniformly humidifying the interior of the storage chamber 4 because of the involving action of the inner stream of the air curtain AC, the trapping action being produced at all times.

Figure 9:
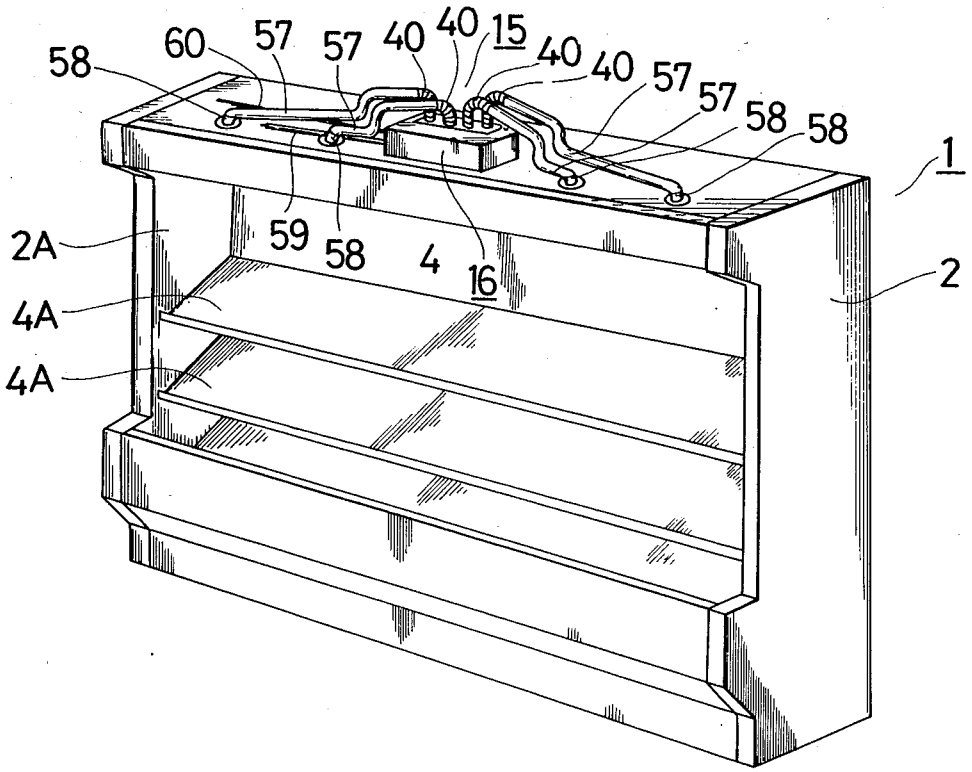
FIG. 9 is a perspective view of a refrigerated display cabinet with an open front side according to another embodiment of the present invention.
Figure 10:
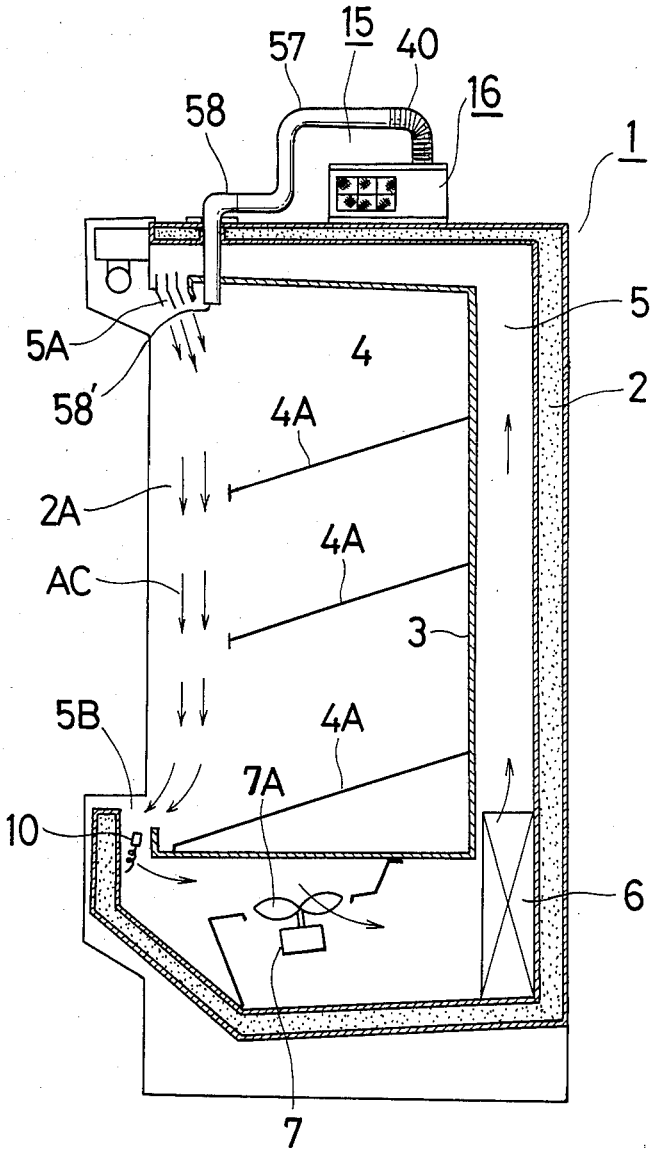
FIG. 10 is a vertical cross-sectional view of the refrigerated display cabinet show in FIG. 9.

FIGS. 9 and 10 are illustrative of a refrigerated display cabinet having a front open side according to another embodiment of the present invention.

The refrigerated display cabinet of the foregoing construction has the following advantages:

(1) By positioning the outlet ports of the outlet pipes for delivering a mist from the humidifier unit in the storage chamber in the vicinity of the outlet of the cooled air passage, the mist from the humidifier unit can be ejected directly toward the air curtain. The mist therefore is not ejected in the cooled air passage, and there is no reduction in the humidifying capability which would be caused by a viscosity resistance by the cooled air passage. The mist can effectively be supplied accordingly. The mist ejected to an upstream portion of the air curtain is caused to flow downstream across the display cabinet opening by the inner stream of the air curtain. Since the mist is dispersed in the mass of cooled air in the storage chamber by the involving action of the inner stream of the air curtain, the storage chamber can uniformly be humidified, and good refrigerating and humidifying action can be achieved.

(2) Since the humidifier unit is positioned outside of the storage chamber and the mist produced from the humidifier unit is delivered through the outlet pipes into the storage chamber, the humidifier unit is not affected by the cooled air, and the problems of a reduced humidifying capability and frozen water, which have been experienced with the conventional refrigerated display unit, are eliminated.

Although certain preferred embodiments have been shown and described, it should be understood that many changes and modifications may be made therein without departing from the scope of the appended claims.

What is claimed is:

1. A refrigerated display cabinet comprising:

an insulated cabinet body having an open side;

a partition plate disposed in said cabinet body defining therein a storage chamber and a cooled air passage, said cooled air passage having an outlet extending along one edge of said open side, said cooled air passage also having an inlet extending along an opposite edge thereof;

a refrigerating unit disposed in said cooled air passage for cooling air therein;

an air blower disposed in said cooled air passage for forcibly circulating air drawn into said inlet through said refrigerating unit, said air thereby being cooled, and then out through said outlet, said cooled air furhter returning into said inlet so as to form a cooled air curtain across said open side for cooling said storage chamber;

a mist-producing humidifier unit disposed in said body outside of said storage chamber so that said humidifier is not cooled by said cooled air curtain; and outlet pipe means for delivering mist produced by said humidifier unit for being mixed in the forcibly circulated cooled air, said outlet pipe means having an outlet port positioned in said storage chamber adjacent said outlet of said cooled air passage and on the side of said formed air curtain nearer said storage chamber, whereby said mist discharged from said outlet port of said outlet pipe means is rapidly mixed through an involving action with an inner stream of said air curtain on the side of said curtain nearer said storage chamber and is gradually dispersed in said storage chamber to uniformly humidify the interior of said storage chamber.

2. The refrigerated display cabinet according to claim 1, wherein said open side of said insulating cabinet body is on an upper side of said body, and said outlet port of said outlet pipe means is positioned below said cooled air passage outlet and opens upwardly so as to eject said mist directly into said cooled air curtain.

3. The refrigerated display cabinet according to claim 1, wherein said outlet pipe means comprises a plurality of outlet pipes extending from said humidifier unit, each having respective outlet ports scattered in said storage chamber, adjacent said outlet of said cooled air passage and positioned so as to eject said mist directly into said air curtain on the side of said curtain nearer said storage chamber.

4. The refrigerated display cabinet according to claim 1, wherein said humidifier unit includes an ultrasonic vibrator for generating said mist.

5. The refrigerated display cabinet according to claim 1, wherein said outlet and inlet of said cooled air passage extend respectively along front and rear edges of the open side of said insulated cabinet body, said refrigerated display cabinet further comprising:

a mirror removably mounted at the upper part of said outlet, said mirror being inclined rearwardly toward its lower edge, said humidifier unit being mounted behind said mirror.

6. The refrigerated display cabinet according to claim 1, wherein said outlet and inlet of said cooled air passage extend respectively along upper and lower edges of the open side of said insulated cabinet body and said humidifier unit is disposed on a top wall of said insulated cabinet body.

7. The refrigerated display cabinet according to claim 1, further comprising:

a humidity sensor mounted at said inlet of said cooled air passage to provide to said humidifier unit a signal representative of humidity of circulated cooled air entering said inlet, said humidifier unit being responsive to said signal, thereby controlling the amount of mist generated from said humidifier unit.

* * * * *